US009726177B2

(12) United States Patent
Choi et al.

(10) Patent No.: US 9,726,177 B2
(45) Date of Patent: Aug. 8, 2017

(54) SCROLL COMPRESSOR

(71) Applicant: LG ELECTRONICS INC., Seoul (KR)

(72) Inventors: Yongkyu Choi, Seoul (KR); Kangwook Lee, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 89 days.

(21) Appl. No.: 14/796,313

(22) Filed: Jul. 10, 2015

(65) Prior Publication Data

US 2016/0040671 A1 Feb. 11, 2016

(30) Foreign Application Priority Data

Aug. 8, 2014 (KR) ..... 10-2014-0102365

(51) Int. Cl.

| | |
|---|---|
| ***F04D 1/04*** | (2006.01) |
| ***F04C 29/00*** | (2006.01) |
| ***F04C 18/02*** | (2006.01) |
| *F04C 23/00* | (2006.01) |
| *F04C 29/02* | (2006.01) |

(52) U.S. Cl.

CPC ..... *F04C 29/0057* (2013.01); *F04C 18/0215* (2013.01); *F04C 23/008* (2013.01); *F04C 29/025* (2013.01); *F04C 2240/50* (2013.01)

(58) Field of Classification Search

CPC ..... F04C 2240/50; F04C 23/008; F04C 29/0057; F04C 29/025; F04C 18/0215

See application file for complete search history.

(56) References Cited

U.S. PATENT DOCUMENTS

| | | | | |
|---|---|---|---|---|
| 4,836,758 | A * | 6/1989 | Elson | F01C 1/0215 384/271 |
| 6,099,278 | A * | 8/2000 | Hugenroth | F01C 21/02 384/297 |
| 6,109,899 | A * | 8/2000 | Barito | F01C 21/02 384/192 |
| 2007/0231178 | A1* | 10/2007 | Su | F04C 23/008 418/182 |
| 2010/0239447 | A1* | 9/2010 | Bush | F04C 18/0215 418/55.1 |
| 2011/0250082 | A1* | 10/2011 | Han | F01C 21/02 417/410.1 |
| 2014/0270613 | A1* | 9/2014 | Iketaka | F16C 19/527 384/462 |
| 2015/0152731 | A1* | 6/2015 | Yamashita | F16C 17/02 418/55.5 |

FOREIGN PATENT DOCUMENTS

KR 10-1059880 B1 8/2011

* cited by examiner

*Primary Examiner* — Jesse Bogue
(74) *Attorney, Agent, or Firm* — KED & Associates, LLP

(57) ABSTRACT

A scroll compressor is disclosed which prevents leakage of refrigerant from a compression chamber and abrasion of bearings between a rotating shaft and an orbiting scroll by reducing the tilting angle of the orbiting scroll, because the allowable bearing angle is equal to or larger than the tilting angle, where the allowable bearing angle θ refers to the maximum angle at which the orbiting scroll is tilted with respect to the rotating shaft, and the tilting angle β refers to the angle at which the orbiting scroll is tilted with respect to the plate.

20 Claims, 6 Drawing Sheets

SCROLL COMPRESSOR

CROSS-REFERENCE TO RELATED APPLICATION

Pursuant to 35 U.S.C. §119(a), this application claims the benefit of earlier filing date and right of priority to Korean Application No. 10-2014-0102365, filed on Aug. 8, 2014, the contents of which is incorporated by reference herein in its entirety.

BACKGROUND OF THE INVENTION

1. Field of the Invention

The present invention relates to a scroll compressor, and more particularly, to a scroll compressor in which an eccentric portion of a rotating shaft is connected to an orbiting wrap of an orbiting scroll in an overlapping manner.

2. Description of the Conventional Art

Generally, scroll compressors are widely used for compressing refrigerant in air conditioning equipment, by virtue of advantages of having a relatively higher compression ratio than other types of compressors and producing stable torque through a seamless sequence of suction, compression, discharge strokes of refrigerant.

Behavior characteristics of a scroll compressor are determined by the configuration of a fixed wrap of a fixed scroll and an orbiting wrap of an orbiting scroll. The fixed wrap and the orbiting wrap may have a certain shape, respectively, but in general, the fixed wrap and the orbiting wrap have an involute shape which makes them easily processable. The involute is a curve traced by an end of a string as it is unwound from a base circle with a certain radius. If the wraps have an involute shape, they have a uniform thickness and their volume changes at a constant rate. Thus, in order to obtain a sufficient compression ratio, the number of windings of the wraps should be increased. However, the scroll compressor becomes larger in size with an increasing number of windings of the wraps.

Typically, the orbiting scroll includes an end plate having a disk shape and the aforementioned orbiting wrap formed on one side of the end plate. A boss portion with a predetermined height is formed on the other side of the end plate where the orbiting wrap is not formed. A rotating shaft to be connected to a rotor of an electric motor portion is eccentrically connected to the boss portion to cause the orbiting scroll to orbit. With this configuration, the orbiting wrap can be formed over almost the whole area of the end plate, thereby reducing the diameter of the end plate for obtaining the same compression ratio. This configuration, however, axially separates the orbiting wrap and the boss portion from each other, and therefore, upon compression, the point of application of a repulsive force of refrigerant and the point of application of a reaction force for canceling out the repulsive force are axially separated from each other. Due to this, the repulsive force and the reaction force act as a couple while the compressor is running, causing the orbiting scroll to be tilted and therefore generating more vibration or noise.

To resolve this problem, there was disclosed a scroll compressor, like the scroll compressor (Korean Patent Registration No. 10-1059880) registered with the Korean Patent Office, in which the point of connection of the rotating shaft and the orbiting scroll is formed in the same plane as the orbiting wrap. This type of scroll compressor is capable of solving the tilting problem of the orbiting scroll because the point of application of a repulsive force of refrigerant and the point of application of a reaction force against the repulsive force act in opposite directions at the same height.

Well-known examples of scroll compressors in which an eccentric portion of a rotating shaft is connected to an orbiting wrap of an orbiting scroll in an overlapping manner include a top-mounted scroll compressor with a compressing portion located on top of an electric motor portion and a bottom-mounted scroll compressor with a compressing portion located under an electric motor portion.

Some top-mounted or bottom-mounted scroll compressors use a back pressure support system which supports the orbiting scroll by the back pressure created by bypassing an intermediate-pressure refrigerant to the back side of the orbiting scroll.

The above back pressure support system may not be able to support the orbiting scroll enough if the back pressure becomes lower due to a change in operating conditions or a high pressure in the compression chamber. As the orbiting scroll is connected to the eccentric portion of the rotating shaft with a fine gap, i.e., a bearing gap, interposed between them, the lack of back pressure may cause the orbiting scroll to wobble, so-called tilting. If this tilting goes beyond an allowable range, the refrigerant will leak from the compression chamber and hence the compression efficiency will drop or a collision will occur between the orbiting scroll and the rotating shaft, thus causing abrasion of bearings.

SUMMARY OF THE INVENTION

An aspect of the present invention is to provide a scroll compressor which prevents leakage of refrigerant compressed in a compression chamber and abrasion of bearings between a rotating shaft and an orbiting scroll by reducing the tilting angle of the orbiting scroll.

In order to accomplish this aspect of the present invention, there is provided a scroll compressor including: a casing; an electric motor portion disposed in an internal space of the casing; a frame disposed in the internal space of the casing; a fixed scroll disposed in the internal space of the casing and having a fixed wrap; an orbiting scroll that is supported on the frame and having a orbiting wrap engages with the fixed wrap of the fixed scroll while orbiting to form a compression chamber; a rotating shaft that transmits torque from the electric motor portion to the orbiting scroll and includes an eccentric portion eccentrically connected to the orbiting scroll, the eccentric portion overlapping the orbiting wrap in the same plane; and bearings disposed between the orbiting scroll and the rotating shaft, wherein allowable bearing angle is equal to or larger than tilting angle, where the allowable bearing angle $\theta$ refers to the maximum angle at which the orbiting scroll is tilted due to a gap between the orbiting scroll and the rotating shaft, and the tilting angle $\beta$ refers to the maximum angle at which the orbiting scroll is tilted due to a gap between the orbiting scroll and the frame, If the diameter tolerance for the bearings is denoted by $\alpha$, the length of the bearings is denoted by L, the back side tolerance for the orbiting scroll corresponding to a gap between the orbiting scroll and the frame is denoted by $\delta$, the radius of the thrust surface of the frame is denoted by D/2, and the orbital radius of the eccentric portion is denoted by r, then the relationship $\alpha/L \geq \delta/(D/2+r)$ is satisfied.

Contact avoidance portions may be formed on the inner peripheral edges of the bearings.

A scroll compressor according to the present invention offers the advantages of preventing leakage of refrigerant from a compression chamber and abrasion of bearings between a rotating shaft and an orbiting scroll by reducing the tilting angle of the orbiting scroll, because allowable bearing angle is equal to or larger than tilting angle, where the allowable bearing angle θ refers to the maximum angle at which the orbiting scroll is tilted with respect to the rotating shaft, and the tilting angle β refers to the angle at which the orbiting scroll is tilted with respect to the plate.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a scroll compressor according to the present invention will be described based on an exemplary embodiment illustrated with reference to the attached drawings.

Figure 1:
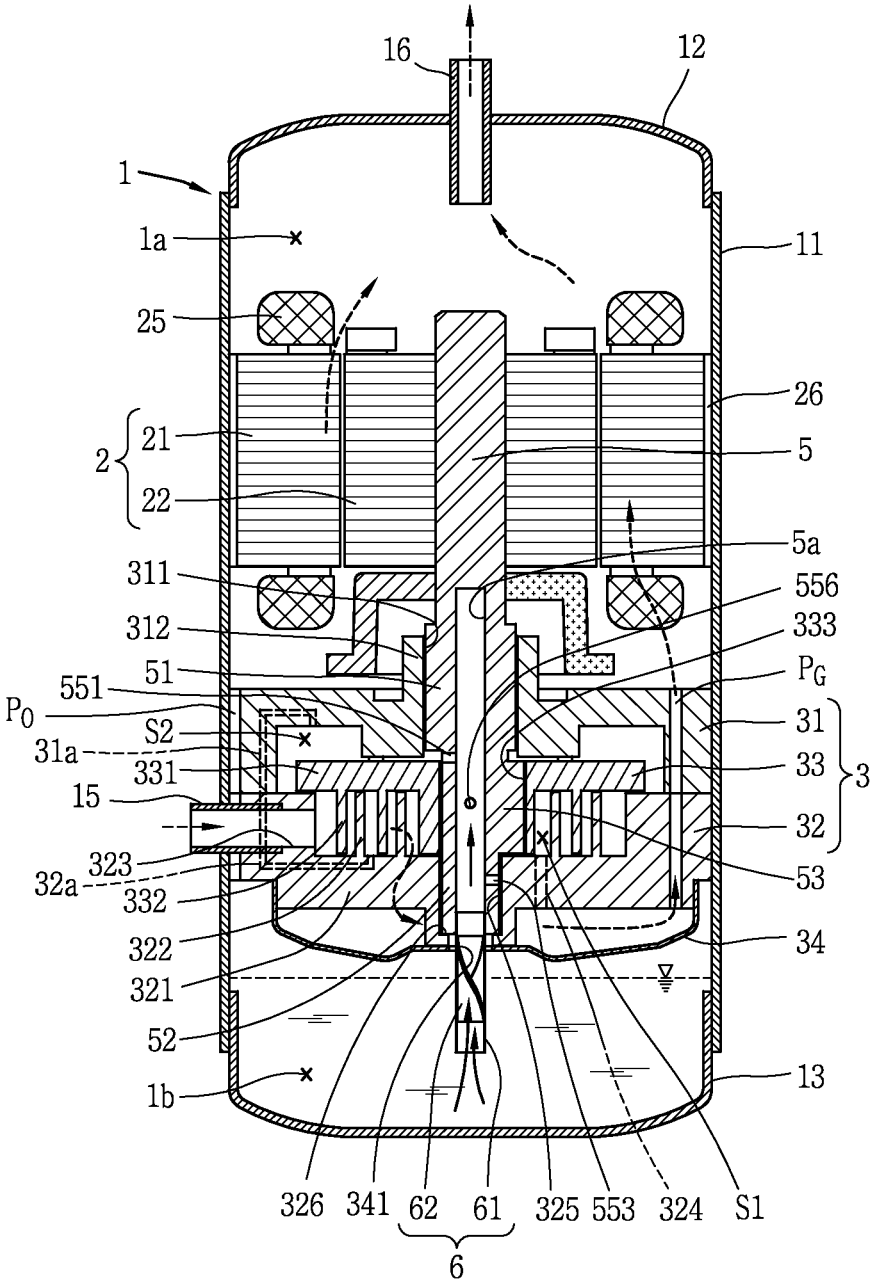
FIG. 1 is a vertical cross-sectional view showing an example of a bottom-mounted scroll compressor according to the present invention.
Figure 2:
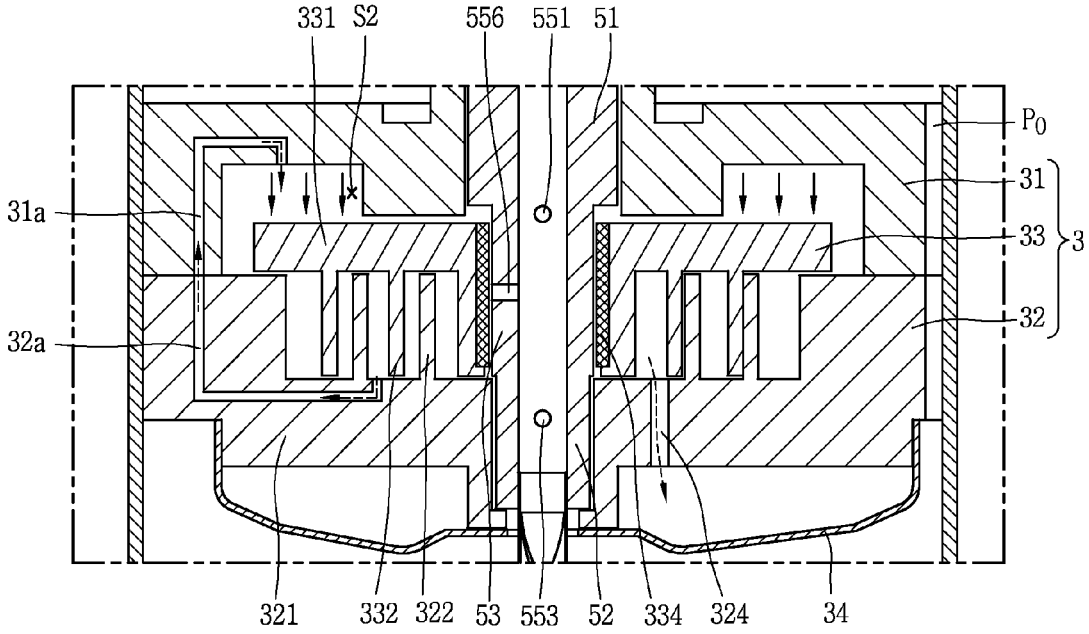
FIG. 2 is a vertical cross-sectional view enlargedly showing a compressing portion in the bottom-mounted scroll compressor of FIG. 1.

As shown in FIGS. 1 and 2, a bottom-mounted scroll compressor according to this exemplary embodiment may include an electric motor portion 2 that is mounted in an internal space 1*a* of a casing 1 and produces torque, and a compressing portion 3 that is mounted under the electric motor portion 2 and receives torque from the electric motor portion 2 to compress refrigerant.

The casing 1 may consist of a cylindrical shell 11 constituting a closed vessel, an upper shell 12 covering the top of the cylindrical shell 11 to constitute the closed vessel, and a lower shell 13 covering the bottom of the cylindrical shell 11 to constitute the closed vessel and forming a oil storage space 1*b*.

A refrigerant suction pipe 15 may penetrate a side of the cylindrical shell 11 and communicate directly with suction chambers in the compressing portion 3, and a refrigerant discharge pipe 16 may be mounted at the top of the upper shell 12 and communicate with the internal space 1*a* of the casing 1. The refrigerant discharge pipe 16 corresponds to a passage through which a compressed refrigerant discharged from the compressing portion 3 to the internal space 1*a* of the casing 1 exits, and an oil separator (not shown) for separating oil mixed in with the discharged refrigerant may be connected to the refrigerant discharge pipe 16.

A stator 21 constituting the electric motor portion 2 is fixedly mounted in an upper part of the casing 1, and a rotor 22 constituting the electric motor portion 2, together with the stator 21, and rotating by interaction with stator 21 may be rotatably mounted within the stator 21.

The stator 11 includes a plurality of slots (not shown) formed circumferentially on the inner peripheral surface, on which coils are wound, and a passage 26 formed in a D-cut shape on the outer peripheral surface, through which refrigerant or oil passes between the outer peripheral surface of the stator and the inner peripheral surface of the cylindrical shell 11.

A mainframe 31 constituting the compressing portion 3 may be fixed to a lower part of the casing 1 under the stator 21, spaced apart a predetermined distance from the stator 21. A fixed scroll (hereinafter, also referred to as a first scroll) 32 may be fixedly mounted on the bottom face of the mainframe 31, with an orbiting scroll (hereinafter, also referred to as a second scroll) 33 interposed between them and eccentrically connected to a rotating shaft 5 to be described later. The orbiting scroll 33 may be orbitally mounted between the mainframe 31 and the fixed scroll 32. The orbiting scroll 33, while orbiting, may form a pair of compression chambers S1 consisting of a suction chamber, an intermediate-pressure chamber, and a discharge chamber, together with the fixed scroll 32. Needless to say, the fixed scroll 32 may be connected to the mainframe 31 to be vertically movable.

The outer peripheral surface of the mainframe 31 may be fixed to the inner peripheral surface of the cylindrical shell 11 by shrink-fitting or welding. A first bearing hole 311 may be axially bored in the center of the mainframe 31. A main bearing unit 51 of the rotating shaft 5 constituting a first bearing unit may be rotatably inserted and supported on the first bearing hole 311. A back pressure chamber S2 may be formed at the bottom face of the mainframe 41, which forms a space, together with the fixed scroll 32 and the orbiting scroll 33, and supports the orbiting scroll 33 by the pressure in the space.

The back pressure chamber S2 may communicate with the intermediate-pressure chambers S1. To this end, a second back pressure passage 31*a* may be formed in the mainframe 31 to communicate with a first back pressure passage 32*a* of the fixed scroll 32 to be described later. The second back pressure passage 31*a* may penetrate the edge of the mainframe 31, i.e., the region contacting the fixed scroll 32, to communicate with the back side of the back pressure chamber S2.

The fixed scroll 32 may include an approximately-circular end plate portion 321 and a fixed wrap 322 that is formed on the top face of the end plate portion 321 and engages with an orbiting wrap 332 to be described later to form the compression chambers S1. A suction port 323 connecting to the refrigerant suction pipe 15 may be formed on one side of the fixed wrap 322, and a discharge port 324 may be formed in the end plate portion 321 to communicate with the discharge chambers and discharge compressed refrigerant.

As the discharge port 324 is formed toward the lower shell 13, a discharge cover 34 for receiving discharged refrigerant and guiding it toward a refrigerant flow path to be described later may be attached to the bottom face of the fixed scroll 32. The discharge cover 34 may be hermetically attached to the bottom face of the fixed scroll 32 so as to separate a refrigerant discharge flow path (not shown) and the oil storage space 1*b*.

The discharge cover 34 may be formed in such a way that the discharge port 324 and the inlet of a refrigerant flow path $P_G$ are accommodated in the internal space. The refrigerant flow path $P_G$ is driven through the fixed scroll 32 and the mainframe 31 to guide the refrigerant discharged from the compression chambers S1 to the internal space of the discharge cover 34, toward the upper internal space 1*a* of the casing 1. The discharge cover 34 may include a through-hole 341 connected to a sub bearing unit 52 of the rotating shaft 5 constituting a second bearing unit so that an oil feeder 6 to be soaked in the oil storage space 1*b* of the casing 1 can pass through.

A second bearing hole 325 may be axially bored in the center of the end plate portion 321 of the fixed scroll 32. The sub bearing unit 52 of the rotating shaft 5 to be described later may be inserted and connected to the second bearing hole 325. A thrust bearing unit 326 may be protruded on the inner periphery of the second bearing hole 325 so as to axially support the lower end of the sub bearing unit 52.

The first back pressure passage 32*a* may be formed in the fixed scroll 32 to provide communication between the intermediate-pressure chambers S1 and the second back pressure chamber 31*a* of the mainframe 31. One end of the first back pressure passage 32*a* may communicate with the intermediate-pressure chambers S1, whereas the other end may be driven through the end plate portion 321 of the fixed scroll 32 to the upper lateral side of it.

The orbiting scroll 33 may include an approximately-circular end plate portion 331 and the orbiting wrap 332 that is formed on the bottom face of the end plate portion 331 and engages with the fixed wrap 322 to form the compression chambers S1. A rotating shaft coupling 333 may axially penetrate the center of the end plate portion 331. An eccentric portion 53 of the rotating shaft 5 to be described later is rotatably inserted and connected to the rotating shaft coupling 333. The outer periphery of the rotating shaft coupling 333 is connected to the orbiting wrap 332 to form the compression chambers S1, together with the fixed wrap 322, in a compression process. The fixed wrap 322 and the orbiting wrap 332 may have various shapes, as well as an involute shape.

The eccentric portion 53 of the rotating shaft 5 to be described later may be inserted and connected to the rotating shaft coupling 333 so that the eccentric portion 53 overlaps the orbiting wrap 332 or the fixed wrap 322 in a radial direction of the compressor. As such, upon compression, a repulsive force of refrigerant is applied to the fixed wrap 322 and the orbiting wrap 332, and a compression force, a reaction force against the repulsive force, is applied between the rotating shaft coupling 333 and the eccentric portion 53. As discussed above, when the eccentric portion 53 of the rotating shaft 5 penetrates the end plate portion 331 of the orbiting scroll 33 and overlaps the orbiting wrap 33 in a radial direction, a repulsive force of refrigerant and a compression force are applied in the same plane relative to the end plate portion and cancel out each other. This prevents tilting of the orbiting scroll 33 caused by application of compression force and repulsive force.

While the upper part of the rotating shaft 5 may be pressed into the center of the rotor 22, the lower part may be connected to the compressing portion 3 and supported in a radial direction. As such, the rotating shaft 5 can transmit torque from the electric motor portion 2 to the orbiting scroll 33 of the compressing portion 3. Then, the orbiting scroll 33 eccentrically connected to the rotating shaft 5 orbits relative to the fixed scroll 32.

The main bearing unit 51 may be formed in the lower-half part of the rotating shaft 5 so as to be inserted in the first bearing hole 311 of the mainframe 31 and supported in a radial direction, and the sub bearing unit 52 may be formed under the main bearing unit 51 so as to be inserted in the second bearing hole 325 of the fixed scroll 32 and supported in a radial direction. The eccentric portion 53 may be formed between the main bearing unit 51 and the sub bearing unit 52 so as to be inserted and connected to the rotating shaft coupling 333 of the orbiting scroll 33. The main bearing unit 51 and the sub bearing unit 52 may be formed on the same axis line to have the same center of axis, and the eccentric portion 53 may be radially eccentric relative to the main bearing unit 51 or the sub bearing unit 52. The sub bearing unit 52 may be eccentric relative to the main bearing unit 51.

The outer diameter of the eccentric portion 53 should be smaller than the outer diameter of the main bearing unit 51 and larger than the outer diameter of the sub bearing unit 52 to make it easy to connect the rotating shaft 5 to the orbiting scroll 33 through the bearing holes 311 and 325 and the rotating shaft coupling 333. However, if the eccentric portion 53 is formed by using an additional bearing, rather than being formed integrally with the rotating shaft 5, the rotating shaft 5 may be inserted and connected to the orbiting scroll 33 through the bearing holes 311 and 325 and the rotating shaft coupling 333, even if the outer diameter of the sub bearing unit 52 is not smaller than the outer diameter of the eccentric portion 53.

An oil flow path 5*a* for feeding oil to the bearing units and the eccentric portion 53 may be formed inside the rotating shaft 5. Since the compressing portion 3 is positioned lower than the electric motor portion 2, the oil flow path 5*a* may be recessed from the lower end of the rotating shaft 5 approximately to the lower end or middle height of the stator 21 or to a height greater than the upper end of the main bearing unit 31.

The oil feeder 6 for pumping the oil filled in the oil storage space 1*b* may be connected to the lower end of the rotating shaft 5, i.e., the lower end of the sub bearing unit 52. The oil feeder 6 may consist of an oil feed pipe 61 inserted and connected to the oil flow path 5*a* of the rotating shaft 5 and an oil suction member 62, such as a propeller, inserted in the oil feed pipe 61 to suck oil. The oil feed pipe 61 may be mounted in such a way that it is threaded through the through-hole 341 of the discharge cover 34 and soaked in the oil storage space 1*b*.

Oil holes and/or oil grooves may be formed in the bearing units and the eccentric portion or between the bearing units so that the oil sucked through the oil flow path is fed to the outer peripheral surfaces of the bearing units and eccentric portion.

In the drawings, unexplained reference numerals 551, 553, and 556 refer to the oil filler holes.

The above-described scroll compressor according to this exemplary embodiment operates as follows.

That is, when a torque is produced by application of electric power to the electric motor portion 2, the rotating shaft 5 connected to the rotor of the electric motor portion 2 rotates. Then, the orbiting scroll 33 connected to the eccentric portion 53 of the rotating shaft 5 continuously moves between the orbiting wrap 332 and the fixed wrap 322 while orbiting, thereby forming a pair of compression chambers S1 each consisting of a suction chamber, an intermediate-pressure chamber, and a discharge chamber. The compression chambers S1 are formed through several consecutive steps as their volume shrinks gradually toward the center.

Then, the refrigerant fed through the suction pipe 15 from outside the casing 1 flows directly into the compression chambers S1. This refrigerant is compressed as it moves toward the discharge chambers of the compression chambers by the orbital motion of the orbiting scroll 33, and then discharged to the internal space of the discharge cover 34 from the discharge chambers through the discharge port 324 of the fixed scroll 32.

The compressed refrigerant discharged to the internal space of the discharge cover 34 will then repeat a series of steps of being discharged to the internal space of the casing 1 through the refrigerant flow path $P_G$ formed all the way through the fixed scroll 32 and the main frame 31 and then discharged out of the casing 1 through the discharge pipe 16.

At this point, part of the refrigerant compressed in the compression chambers S1 flows from the intermediate-pressure chambers into the back pressure chamber S2 disposed between the main frame 31 and the orbiting scroll 33, through the first back pressure passage 32*a* and the second back pressure passage 31*a*. Then, the pressure in the back pressure chamber S2 rises above a certain level, and prevents axial leakage between the orbiting scroll 33 and the fixed scroll 32 by supporting the orbiting scroll 33 toward the fixed scroll 32 and at the same time prevents tilting of the orbiting scroll 33 by stably pressurizing the orbiting scroll 33.

However, if the operating condition changes or the pressure in the compression chambers rises too high, the pressure in the back pressure chamber becomes lower, leading to a failure to stably support the orbiting scroll. This can contribute to the tilting problem, i.e., wobbling of the orbiting scroll.

This exemplary embodiment is directed to prevent refrigerant leakage from the compression chambers and local abrasion of the bearings by keeping the orbiting scroll from being tilted even if the back pressure on the orbiting scroll becomes lower.

Figure 3:
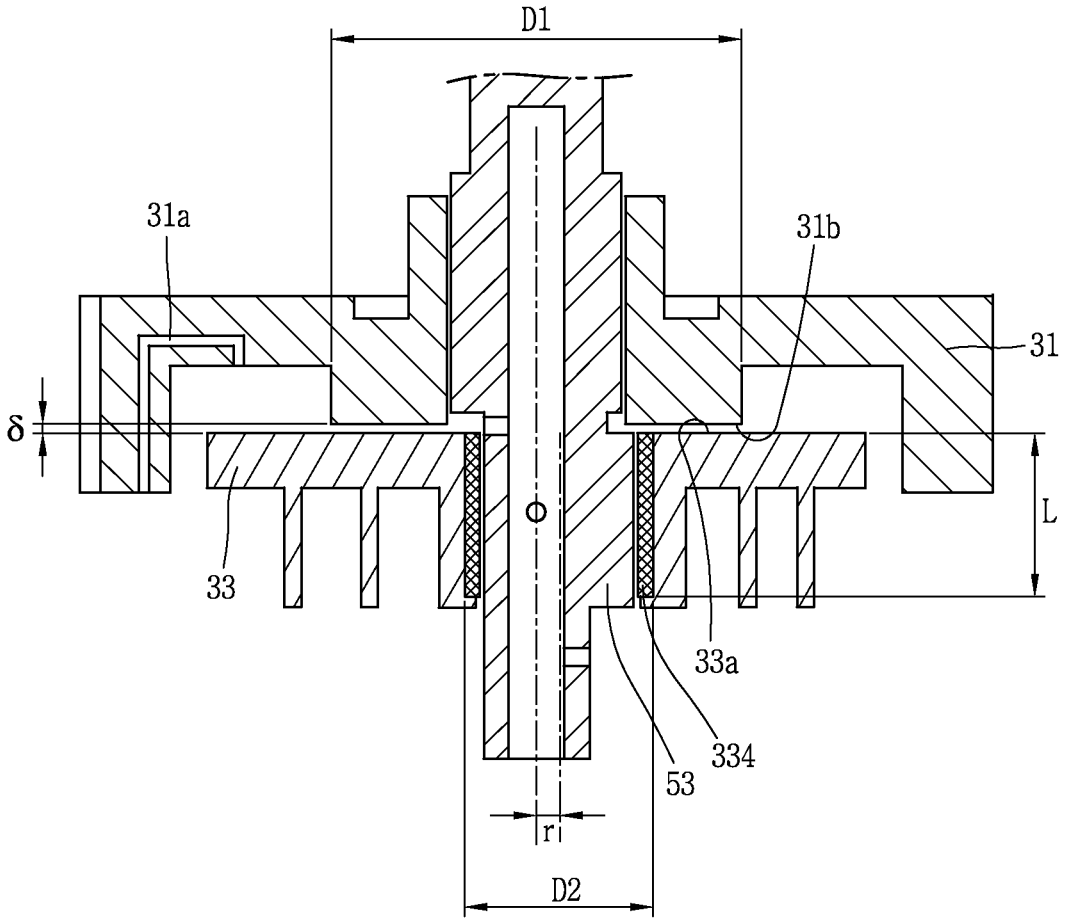
FIG. 3 is a vertical cross-sectional view for explaining the elements defining tilting of an orbiting scroll with reference to FIG. 2.
Figure 4:
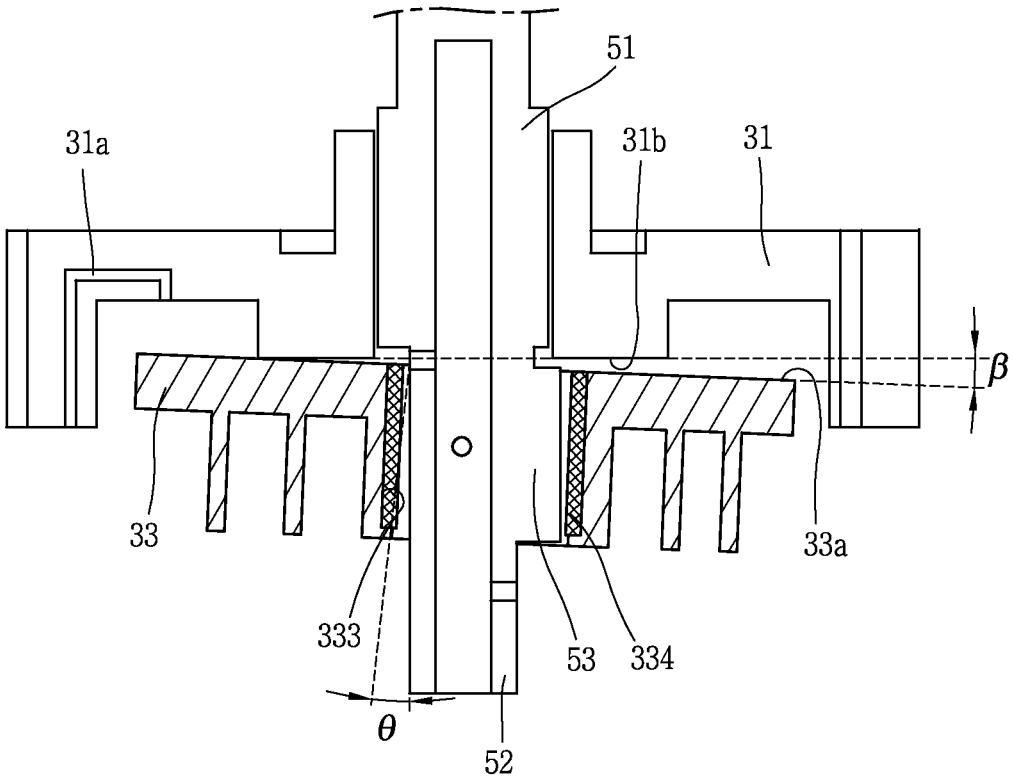
FIG. 4 is a schematic view for explaining tilting angle and allowable bearing angle with reference to FIG. 3.

To this end, in this exemplary embodiment of the present invention, as shown in FIGS. 3 and 4, allowable bearing angle $\theta$ is equal to or larger than tilting angle $\beta$, where the allowable bearing angle $\theta$ refers to the maximum angle at which the orbiting scroll 33 is tilted with respect to the rotating shaft 5, i.e., the maximum angle at which the orbiting scroll 33 is tilted due to gaps between bush bearings 334 inserted into the rotating shaft coupling 333 of the orbiting scroll 33 and the eccentric portion 53 of the rotating shaft 5 inserted and connected to the bush bearings 334, and the tilting angle $\beta$ refers to the angle at which the orbiting scroll 33 is tilted with respect to the mainframe 31, i.e., the maximum angle at which the back side of the orbiting scroll 33 is tilted due to a gap between a thrust surface of the mainframe 31 and the orbiting scroll 33. The bush bearings may be pressed into the eccentric portion of the rotating shaft.

More specifically, if the diameter tolerance for the bearings is denoted by $\alpha$, the length of the bearings is denoted by L, the back side tolerance for the orbiting scroll is denoted by $\delta$, the radius of the thrust bearing surface of the mainframe is denoted by D/2, and the orbital radius of the eccentric portion is denoted by r, then the relationship $\alpha/L \geq \delta/(D/2+r)$ is satisfied. The tilting angle and the back side tolerance can be calculated from the allowable bearing angle, or inversely the allowable bearing angle and the diameter tolerance for the bearings can be calculated from the tilting angle and the back side tolerance.

For instance, suppose that the diameter D1 of the thrust surface of the mainframe is 60 nm, the bearing diameter D2 is 25 mm, the bearing length L is 25 mm, and the orbital radius r is 4 mm, the tilting angle and the back side tolerance can be calculated as follows.

That is, $\theta=\alpha/L$ means that $\alpha=\theta\times L$. Hence, for the common diameter tolerance $\alpha=1.5/1000\times 25=0.0375\approx 0.038$ mm, the allowable bearing angle $\theta$ is $0.038/25=0.00152$ rad=0.087 degrees.

Therefore, the tilting angle is equal to or less than 0.087 degrees because it must be equal to or less than the allowable bearing angle.

The tilting angle $\beta$ equals $\delta/(D/2+r)$, so the back side tolerance $\delta$ is equal to or less than 0.00152 rad$\times(60/2+4)=$ 0.052 mm.

The allowable bearing angle and the bearing diameter tolerance can be calculated as follows.

If the back side tolerance is 0.02 mm, the tilting angle $\beta$ is $0.02/(60/2+4)=0.000588$ rad$\approx$0.034 degree.

Therefore, the allowable bearing angle is equal to or greater than 0.034 degrees because it must be equal to or greater than the tilting angle.

The bearing diameter tolerance $\alpha$ is equal to or greater than $25\times 0.000588$ rad$=0.0147\approx 0.015$ mm.

If the orbiting scroll, as stated above, is tilted as the pressure in the back pressure chamber becomes lower, the allowable bearing angle $\theta$ becomes equal to or larger than the tilting angle $\beta$, as shown in FIG. 4. As such, the back side 33*a* of the orbiting scroll 33 and the thrust surface of the mainframe 31 come into contact with each other at the same time as or before the bush bearings 334 and the eccentric portion 53 do.

Accordingly, even if the orbiting scroll 33 is tilted, the actual angle of tilt of the orbiting scroll 33 is not large. As such, refrigerant leakage from the compression chambers S1 can be minimized, and local abrasion of the bush bearings 334 can be prevented because the bush bearings 334 and the eccentric portion 53 are not in contact with each other.

For a scroll compressor according to the present invention in which an orbiting wrap and an eccentric portion overlap in a radial direction, contact avoidance portions 334*a* may be formed on at least either the inner peripheral surfaces of the bush bearings 334 or the outer peripheral surface of the eccentric portion 53, thus making the allowable bearing angle $\alpha$ larger than the tilting angle $\beta$.

Figure 5:
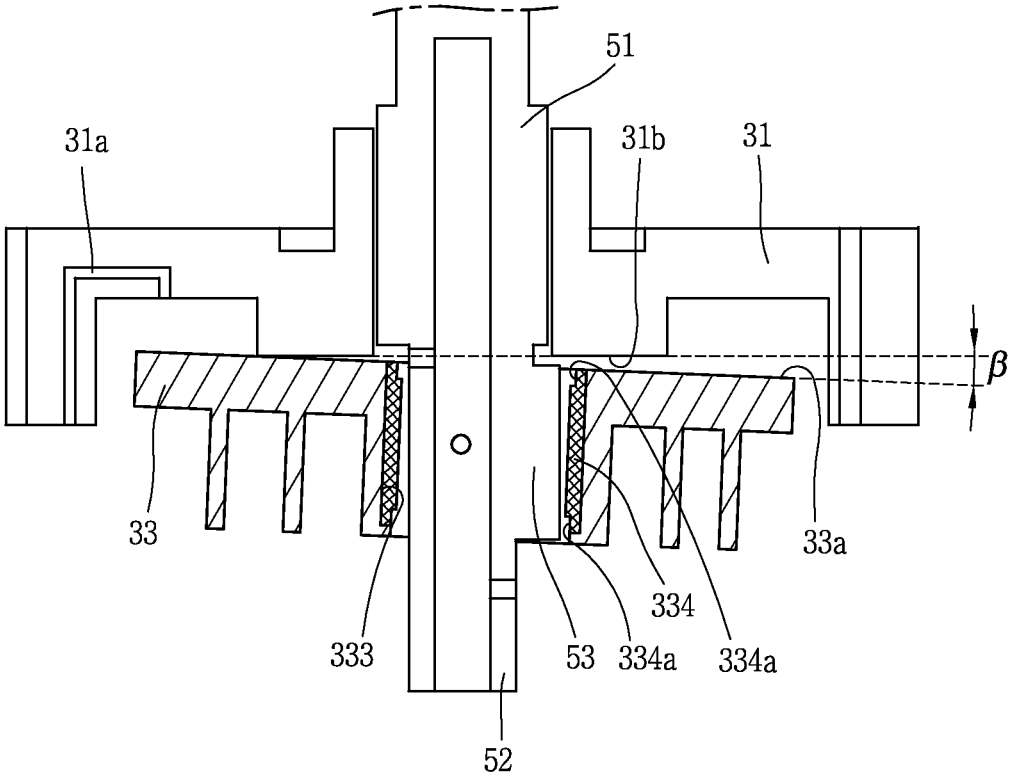
FIG. 5 is a vertical cross-sectional view showing other examples for suppressing tilting of the orbiting scroll with reference to FIG. 2.

For example, as shown in FIG. 5, the contact avoidance portions 334*a* may be formed by recessing both outer peripheral edges of the bush bearings 334 in an annular shape or chamfering them at an angle. Although the contact avoidance portions 334*a* in the drawings are formed on the inner peripheral surfaces of the bush bearings 334, they also may be formed, in some cases, on the outer peripheral edge of the eccentric portion contacting the bush bearings.

Preferably, the depth of the contact avoidance portions 334*a* may be no more than ½ of the thickness of the bush bearings 334 so as to prevent deformation or the like when the bush bearings 334 are pressed into place.

Preferably, the axial length of the contact avoidance portions 334*a* may be no more than ½ of the whole length of the bush bearings 334 so as to provide a sufficient bearing area.

A scroll compressor according to another exemplary embodiment of the present invention will be described below.

That is, while the foregoing exemplary embodiment applies to a bottom-mounted scroll compressor with a compressing portion located under the electric motor portion, this exemplary embodiment applies equally to a top-mounted scroll compressor with a compressing portion located on top of the electric motor portion.

Figure 6:
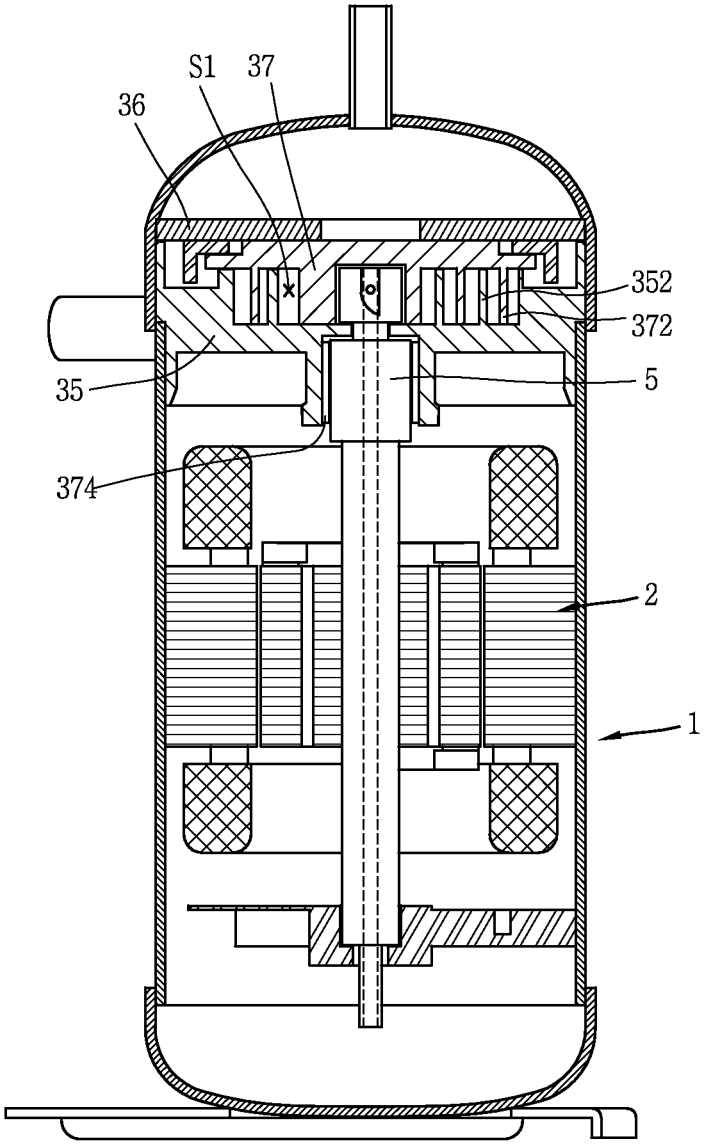
FIG. 6 is a vertical cross-sectional view showing an example in which a tilting structure according to the present invention is applied to a top-mounted scroll compressor.

As shown in FIG. 6, a top-mounted scroll compressor according to this exemplary embodiment may include an electric motor portion 2 mounted in a lower part within a casing 1, and a compressing portion 3 mounted above the electric motor portion 2.

The compressing portion 3 may include a frame 35 with a fixed wrap 352 fixed to the casing 1, a plate 36 connected to the top face of the frame 35, and an orbiting scroll 37 with an orbiting wrap 372 that is mounted between the frame 35 and the plate 35 and engages with the fixed wrap 352 to form a pair of compressing chambers S1.

A rotating shaft coupling 373 may be formed at the orbiting scroll 37 so that an eccentric portion 53 of a rotating shaft 5 connected to a rotor of the electric motor portion 2 is eccentrically connected to it. The rotating shaft coupling 373 may be formed in such a way that the eccentric portion 53 overlaps the compression chambers S1 in a radial direction and bush bearings 374 constituting a bearing unit, along with the eccentric portion 53 of the rotating shaft 5, are formed on the inner peripheral surface.

In this case, too, allowable bearing angle is equal to or larger than tilting angle, where the allowable bearing angle θ refers to the maximum angle at which the orbiting scroll 37 is tilted with respect to the rotating shaft 5, and the tilting angle β refers to the angle at which the orbiting scroll 33 is tilted with respect to the plate 35. The operational effects of the top-mounted scroll compressor may be similar to those of the bottom-mounted scroll compressor. Hence, a detailed description of the top-mounted scroll compressor will be omitted.

What is claimed is:

1. A scroll compressor, comprising:

a frame provided in an internal space of a casing;

a fixed scroll fixedly provided in the internal space of the casing and having a fixed wrap;

an orbiting scroll provided between the frame and the fixed scroll and having an orbiting wrap that engages with the fixed wrap of the fixed scroll to form a compression chamber;

a rotational shaft comprising an eccentric portion eccentrically connected to the orbiting scroll; and bearings provided between the orbiting scroll and the eccentric portion of the rotational shaft, wherein a tilting angle is equal to or smaller than an allowable bearing angle such that the orbiting scroll and the frame come into contact with each other at the same time as or before the bearings and the eccentric portion of the rotational shaft come into contact with each other, and wherein the allowable bearing angle refers to a maximum angle at which the orbiting scroll is tilted due to a gap between the orbiting scroll and the rotational shaft, and the tilting angle refers to a maximum angle at which the orbiting scroll is tilted due to a gap between the orbiting scroll and the frame or the fixed scroll.

2. The scroll compressor of claim 1, wherein, if a diameter tolerance for the bearings is denoted by α, a length of the bearings is denoted by L, a back side tolerance for the orbiting scroll corresponding to the gap between the orbiting scroll and the frame is denoted by δ, a radius of a thrust surface of the frame is denoted by D/2, and an orbital radius of the eccentric portion is denoted by r, then a relationship $\alpha/L \geq \delta/(D/2+r)$ is satisfied.

3. The scroll compressor of claim 1, wherein contact avoidance portions are formed on inner peripheral edges of the bearings, and wherein the contact avoidance portions are configured to avoid contact between an inner surface of the bearings and an outer surface of the rotational shaft.

4. The scroll compressor of claim 3, wherein a depth of the contact avoidance portions is no more than ½ of a thickness of the bearings.

5. The scroll compressor of claim 3, wherein an axial length of the contact avoidance portions is no more than ½ of a whole length of the hearings.

6. The scroll compressor of claim 5, wherein at least a portion of the eccentric portion overlaps the orbiting wrap in a same plane.

7. The scroll compressor of claim 6, wherein the rotational shaft penetrates and IS connected to the orbiting scroll.

8. The scroll compressor of claim 7, wherein both sides of the rotational shaft are supported on the frame and the fixed scroll, respectively, in a radial direction, with the eccentric portion of the rotational shaft interposed between the frame and fixed scroll.

9. The scroll compressor of claim 8, wherein a first bearing unit radially supported on the frame and a second bearing unit radially supported on the fixed scroll are formed on the rotational shaft, with the eccentric portion formed between the first bearing unit and the second bearing unit, and wherein the first bearing unit and the second bearing unit are formed on the same axis line.

10. The scroll compressor of claim 6, wherein the eccentric portion is formed on one end of the rotational shaft.

11. The scroll compressor of claim 10, wherein the rotational shaft penetrates and is connected to the fixed scroll, and wherein the rotational shaft is supported on the fixed scroll in a radial direction.

12. The scroll compressor of claim 1, further comprising an electric motor provided at an upper portion of the casing, wherein the electric motor includes:

a stator fixedly mounted above the frame; and a rotor rotatably mounted within the stator, which is rotated by interaction with the stator.

13. The scroll compressor of claim 12, wherein the rotational shaft is connected to the rotor to rotate with the rotor.

14. The scroll compressor of claim 1, further comprising:

a refrigerant suction pipe penetratingly provided at a side of the casing, wherein the refrigerant suction pipe communicates with a suction side of the compression chamber; and a refrigerant discharge pipe mounted at a top of the casing, through which a refrigerant compressed in the compression chamber is discharged out of the casing.

15. A scroll compressor comprising:

a casing;

an electric motor provided in an internal space of the casing;

a frame provided in the internal space of the casing at a lower portion of the electric motor;

a fixed scroll fixed to the frame in a lower portion of the frame and having a fixed wrap;

an orbiting scroll that is located between the frame and the fixed scroll and comprises an orbiting wrap and a rotational shaft coupling, wherein the orbiting wrap engages with the fixed wrap to form a pair of compression chambers each having a suction chamber, an intermediate-pressure chamber, and a discharge chamber, and wherein the rotational shaft coupling overlaps the orbiting wrap in a radial direction; and a rotational shaft eccentrically connected to the rotational shaft coupling of the orbiting scroll, wherein a maximum angle at which the orbiting scroll is tilted with respect to the frame is equal to or smaller than a maximum angle at which the orbiting scroll is tilted with respect to the rotational shaft.

16. The scroll compressor of claim 15, wherein cylindrical bearings are provided between the rotational shaft and the rotational shaft coupling, and wherein if a diameter tolerance for the cylindrical bearings is denoted by $\alpha$, a length of the cylindrical hearings is denoted by L, a back side tolerance for the orbiting scroll corresponding to a gap between the orbiting scroll and the frame is denoted by $\delta$, a radius of a thrust surface of the frame is denoted by D/2, and an orbital radius of the eccentric portion is denoted by r, then a relationship $\alpha/L \geq \delta/(D/2+r)$ is satisfied.

17. The scroll compressor of claim 16, wherein the cylindrical bearings are provided between the rotational shaft and the rotational shaft coupling, wherein contact avoidance portions are formed on inner peripheral edges of the cylindrical bearings, and wherein the contact avoidance portions are configured to avoid contact between an inner surface of the cylindrical bearings and an outer surface of the rotational shaft.

18. A scroll compressor comprising:

a casing;

an electric motor provided in an internal space of the casing;

a frame provided in the internal space of the casing at a lower portion of the electric motor;

a fixed scroll fixed to the frame in a lower portion of the frame and having a fixed wrap;

an orbiting scroll that is located between the frame and the fixed scroll and comprises an orbiting wrap and a rotational shaft coupling, wherein the orbiting wrap engages with the fixed wrap to form a pair of compression chambers each having a suction chamber, an intermediate-pressure chamber, and a discharge chamber, and wherein the rotational shaft coupling overlaps the orbiting wrap in a radial direction;

a rotational shaft eccentrically connected to the rotational shaft coupling of the orbiting scroll; and bearings provided between the rotational shaft and the rotational shaft coupling, wherein contact avoidance portions are formed on inner peripheral edges of the bearings such that the orbiting scroll and the frame come into contact with each other at the same time as or before the bearings and the eccentric portion of the rotational shaft come into contact with each other.

19. The scroll compressor of claim 18, wherein a depth of the contact avoidance portions is no more than ½ of a thickness of the bearings.

20. The scroll compressor of claim 18, wherein an axial length of the contact avoidance portions is no more than ½ of a whole length of the hearings.

* * * * *